US006592007B2

(12) United States Patent
Ho et al.

(10) Patent No.: US 6,592,007 B2
(45) Date of Patent: Jul. 15, 2003

(54) DISPENSER WITH DECORATION DEVICE

(76) Inventors: Stanley Ho, 18, Nottingham Way, Warren, NJ (US) 07095; Hsiao-Liang Ho, 8F, No. 167, TunHwa N. Road, Taipei (TW)

( * ) Notice: Subject to any disclaimer, the term of this patent is extended or adjusted under 35 U.S.C. 154(b) by 256 days.

(21) Appl. No.: 09/839,006

(22) Filed: Apr. 20, 2001

(65) Prior Publication Data

US 2002/0047024 A1 Apr. 25, 2002

(30) Foreign Application Priority Data

Oct. 9, 2000 (TW) ..... 89217523 U

(51) Int. Cl.[7] ..... G09F 19/08; B05B 11/00

(52) U.S. Cl. ..... 222/78; 222/113; 222/192; 222/321.7; 222/321.9

(58) Field of Search ..... 222/78, 113, 192, 222/321.1, 321.7, 321.9, 383.1, 385

(56) References Cited

U.S. PATENT DOCUMENTS 6,065,640 A * 5/2000 Ho et al. ..... 222/78
6,105,819 A * 8/2000 Ho et al. ..... 222/78
6,138,870 A * 10/2000 Lin ..... 222/78
6,193,106 B1 * 2/2001 Ho et al. ..... 222/78
6,279,778 B1 * 8/2001 Ho et al. ..... 222/78
6,340,099 B1 * 1/2002 Ho et al. ..... 222/78

FOREIGN PATENT DOCUMENTS

GB 2361267 A * 10/2001 ..... B05B/11/00
WO WO 9847810 A1 * 10/1998 ..... B67D/5/00
WO WO 9966480 A1 * 12/1999 ..... G09F/3/00

* cited by examiner

*Primary Examiner*—Kenneth Bomberg

(57) ABSTRACT

A dispenser includes a container having a squeeze device connected on a top thereof and a performance unit is connected to the container. A performance member is located in the performance unit and activated by an activation member which is received in a box connected to the performance unit. A base has a switch member and is movably engaged with the performance unit. A gap is defined between the switch member and the activation member so that when pushing the squeeze device, the performance unit is lowered relative to the base, and the switch member is touched by the lowered activation member so as to activate the performance member.

8 Claims, 12 Drawing Sheets

DISPENSER WITH DECORATION DEVICE

FIELD OF THE INVENTION

The present invention relates to a dispenser having a chamber for receiving liquid or cream and a performance unit is connected to the chamber. A performance member is received in the performance unit and is activated by pushing the squeeze head on the dispenser.

BACKGROUND OF THE INVENTION

A conventional dispenser for dispensing cream such as body lotion or shampoo generally includes a container with a squeeze device connected to an open top of the container. Cream or liquid is received in the container and the squeeze device includes a tube which inserted into the container so that when pushing the squeeze device, the cream or liquid is sucked into the tube and dispensed from an outlet of the squeeze device. The design for the conventional dispenser is focused on its function and cannot provide any other feature.

The present invention intends to provide a dispenser that has a decoration device connected to the container so that the decoration device is activated when using the squeeze device of the dispenser.

SUMMARY OF THE INVENTION

In accordance with one aspect of the present invention, there is provided a dispenser and comprises a container having a squeeze device connected on a top thereof and a performance unit is connected to the container. A performance member is located in the performance unit and a box is connected to the performance unit. An activation member is received in the box and the performance member is activated by the activation member. A base has a switch member and is movably engaged with the performance unit. The switch member is touched by the activation member when pushing the squeeze device.

The primary object of the present invention is to provide a dispenser which provides active decoration feature when using the squeeze device on the dispenser.

The present invention will become more obvious from the following description when taken in connection with the accompanying drawings which show, for purposes of illustration only, several preferred embodiments in accordance with the present invention.

DETAILED DESCRIPTION OF THE INVENTION

Figure 1:
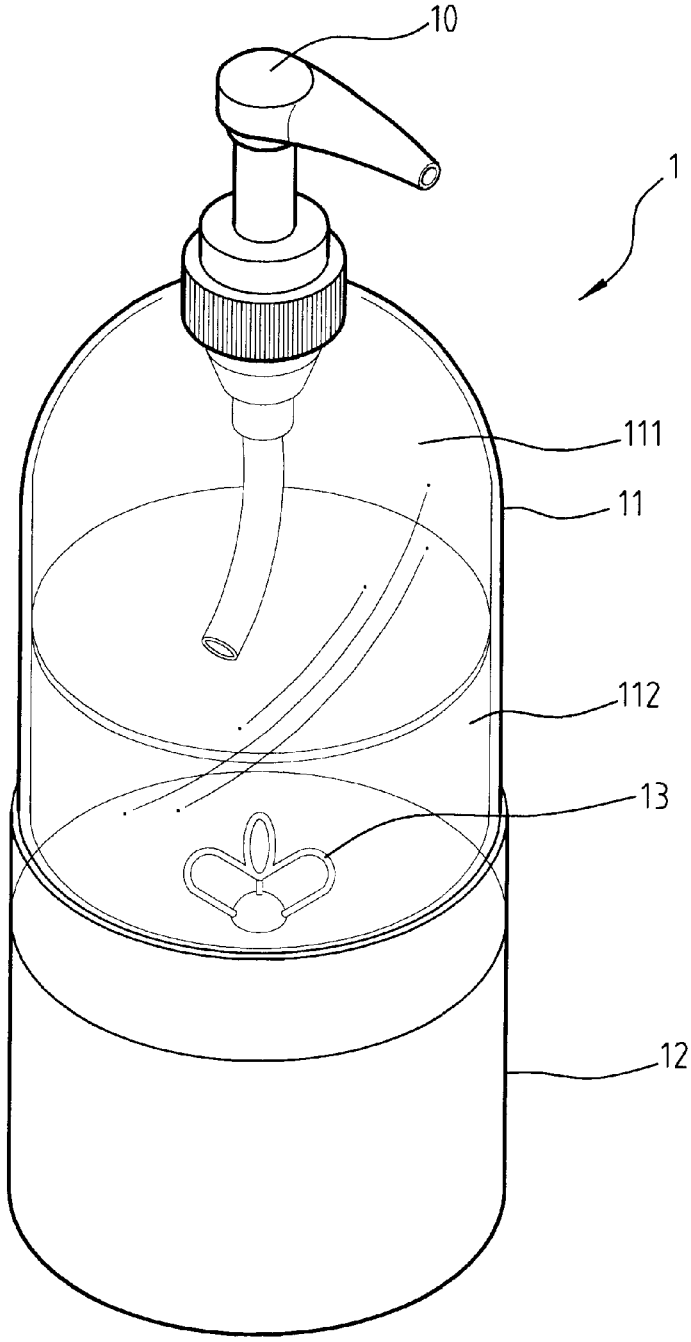
FIG. 1 is a perspective view to show the dispenser of the present invention.
Figure 2:
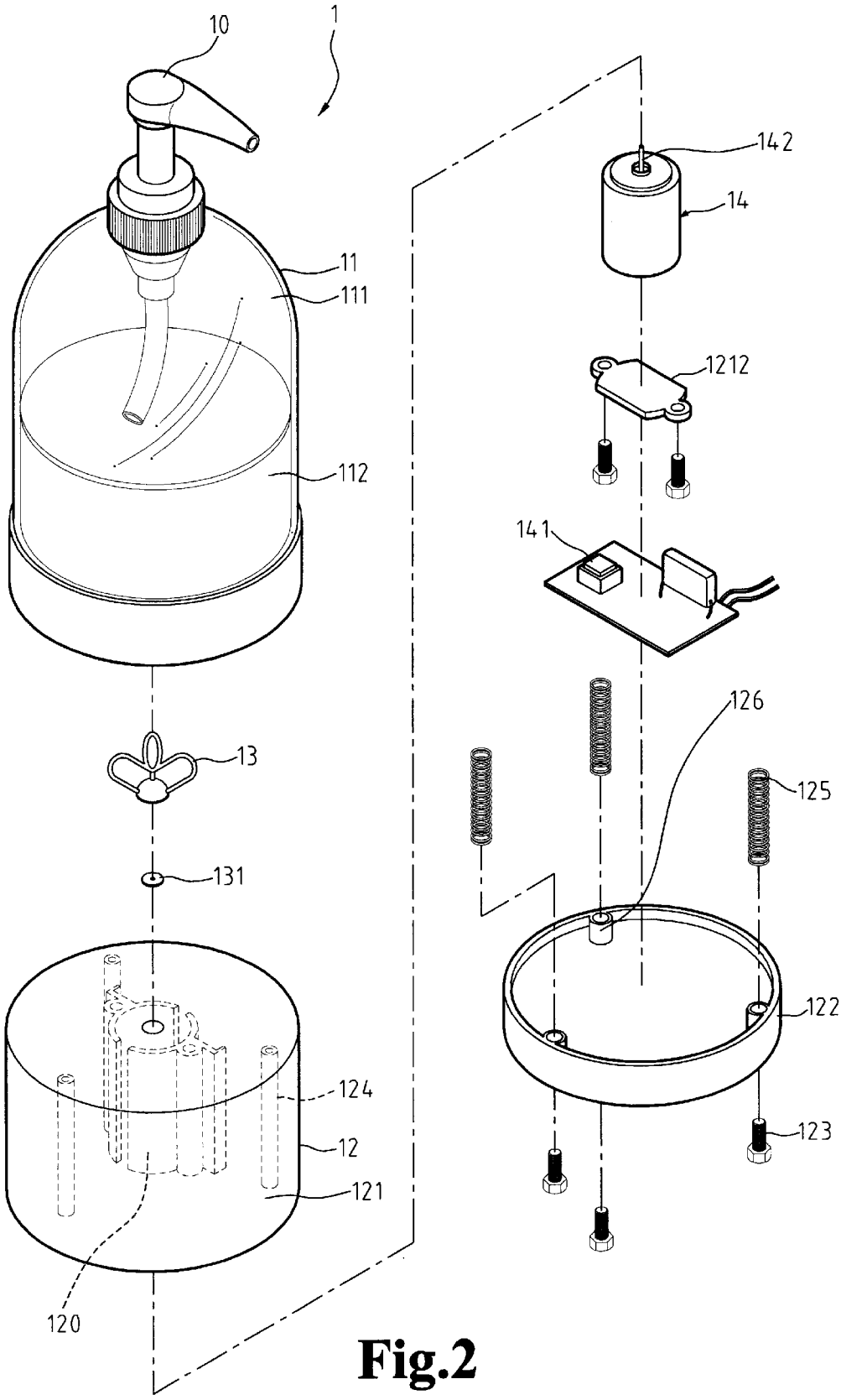
FIG. 2 is an exploded view to show the dispenser of the present invention.
Figure 3:
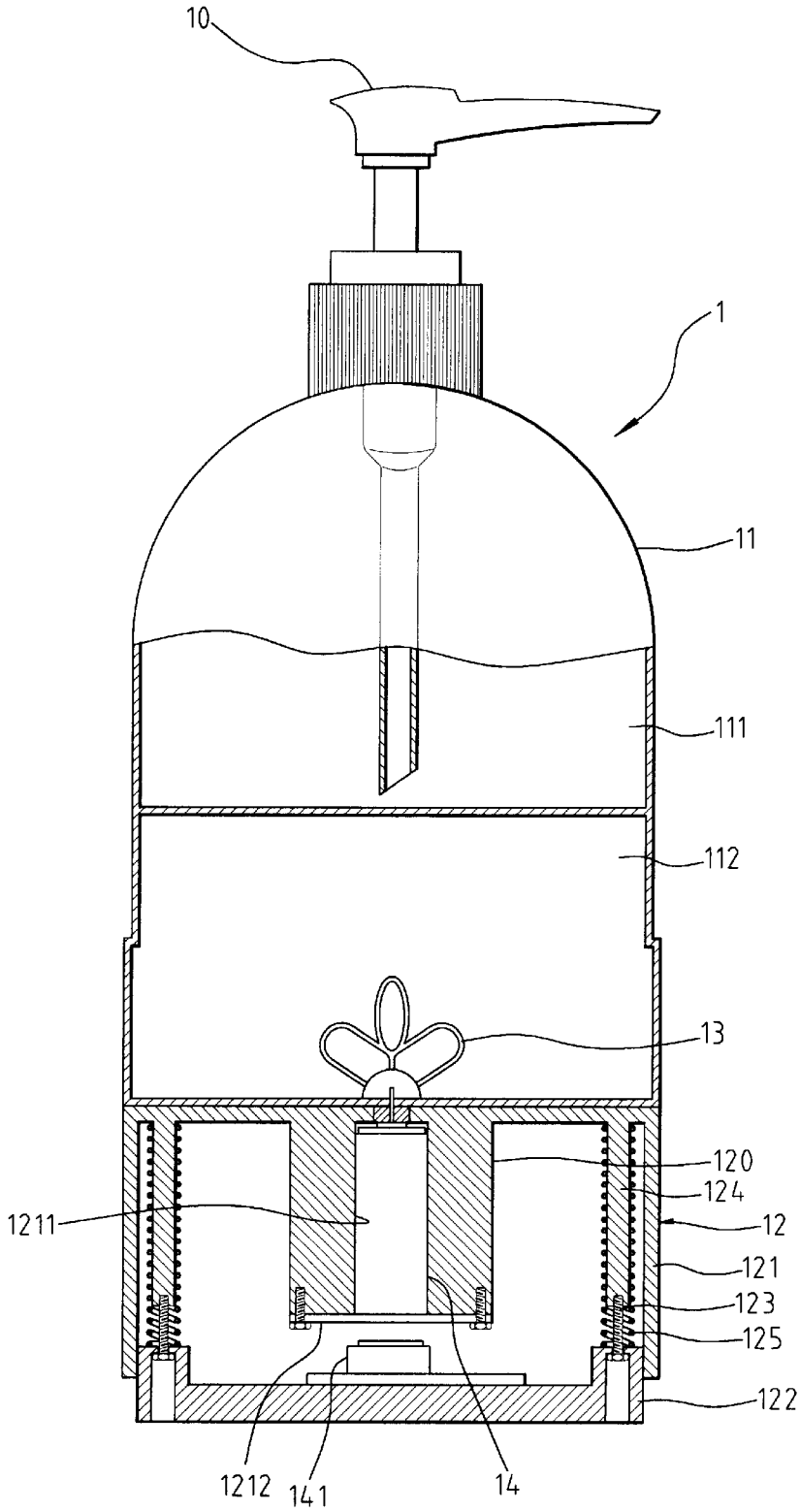
FIG. 3 is a cross sectional view to show the dispenser of the present invention.

Referring to FIGS. 1 to 3, the dispenser 1 of the present invention comprises a container 11 having a squeeze device 10 connected on a top thereof and a chamber 111 is defined in the container 11. A performance unit 112 is connected to the container 11 and a performance member 13 is located in the performance unit 112. A box 12 is connected to the performance unit 112 and has a skirt 121. A tubular portion 120 extends from an inside of the box 12 and a recess 1211 is defined in the tubular portion 120 from an underside of the tubular portion 120. An activation member 14, a motor in this embodiment, is received in the recess 1211 and a shaft 142 of the activation member 14 extends through the box 12 so as to be connected to the performance member 13. If the chamber 111 is filled with liquid or cream, a seal 131 is mounted to the shaft 142 to prevent from leakage. A plate 1212 is connected to the underside of the tubular portion 12. A plurality of rods 124 extend from an inside of the box 12 and a base 122 is enclosed by the skirt 121. The base 122 has rings 126 extending from an inner periphery thereof and a plurality of bolts 123 extend through the rings 126 and are engaged with the rods 124. Each of the rods 124 has a spring 125 mounted thereto which contacts the rings 126 so that the box 12 is moved toward the base 122 while the base 122 is fixed. A switch member 141 is located on the base 122 and a gap defined between the switch member 141 and the activation member 14.

Figure 4:
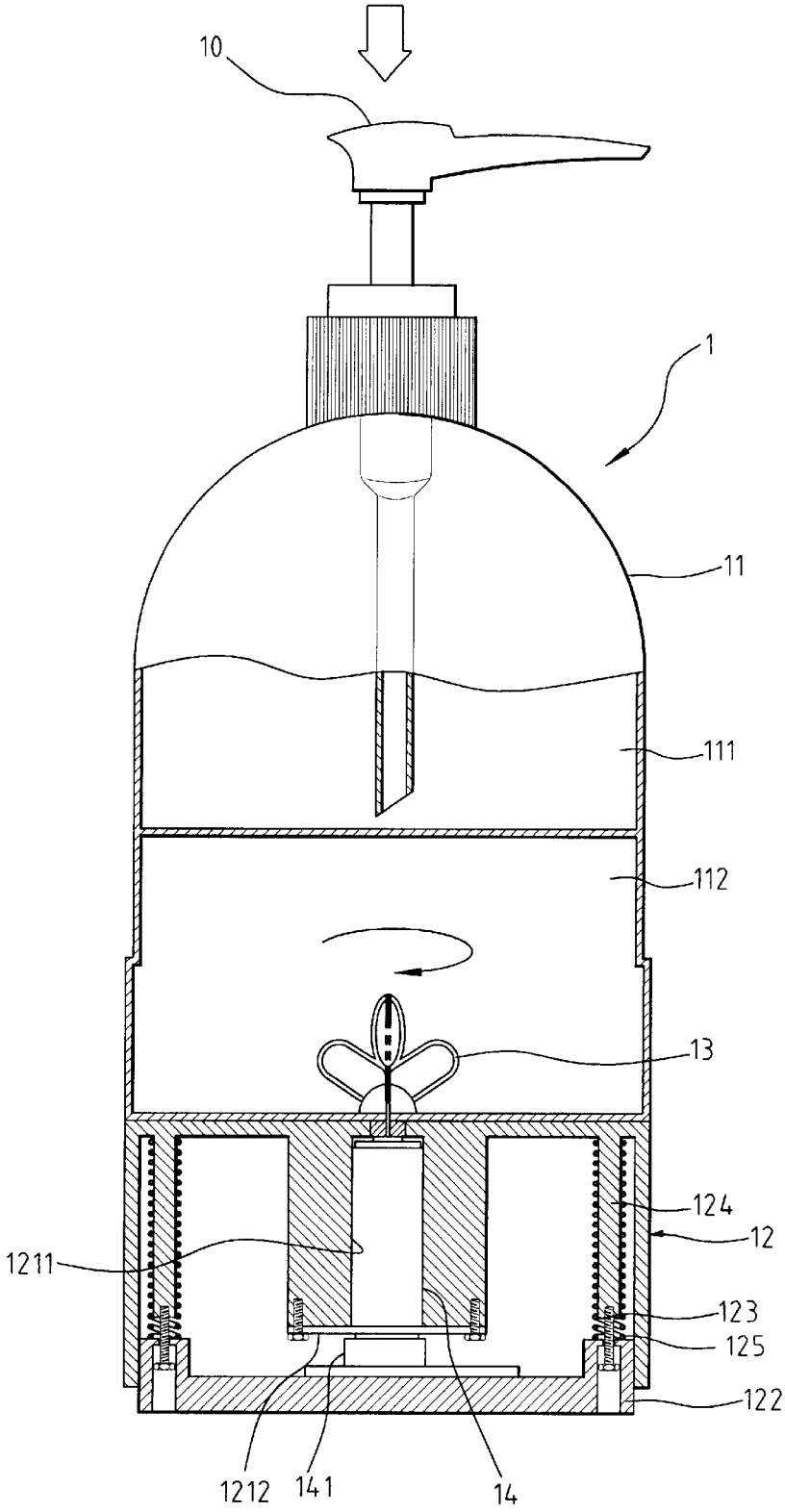
FIG. 4 is a cross sectional view to show the performance member is rotated when pushing the squeeze member of the dispenser of the present invention.
Figure 5:
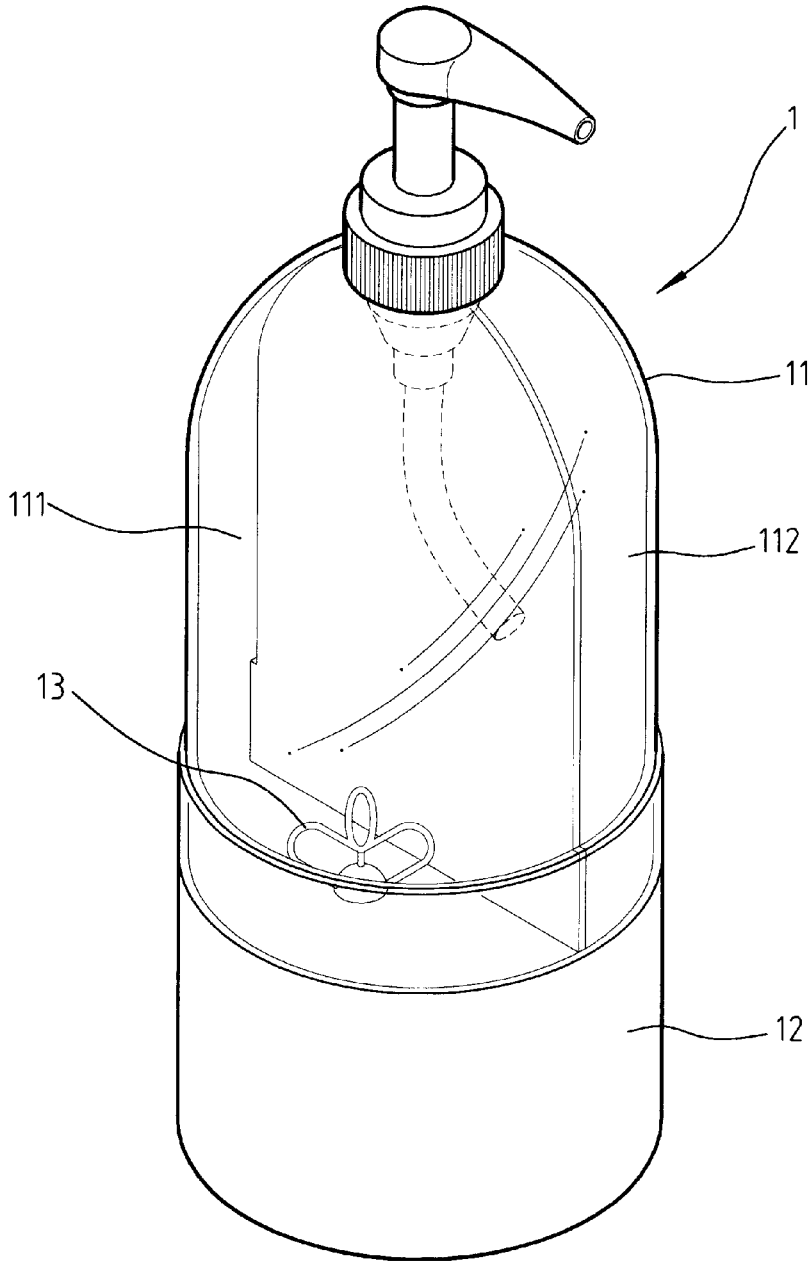
FIG. 5 is a perspective view to show another embodiment of the dispenser of the present invention.
Figure 6:
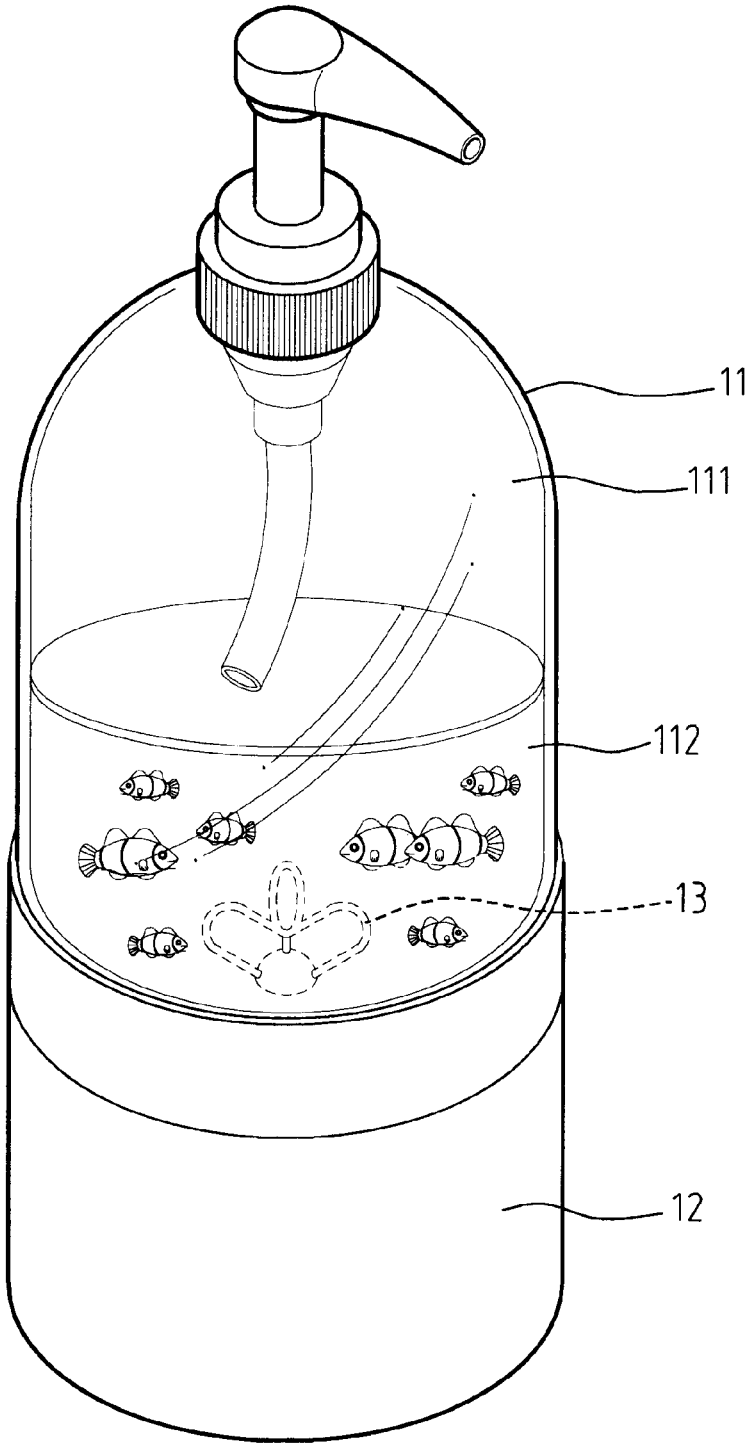
FIG. 6 is a perspective view to show decoration members a relocated in the performance unit of the dispenser of the present invention.
Figure 7:
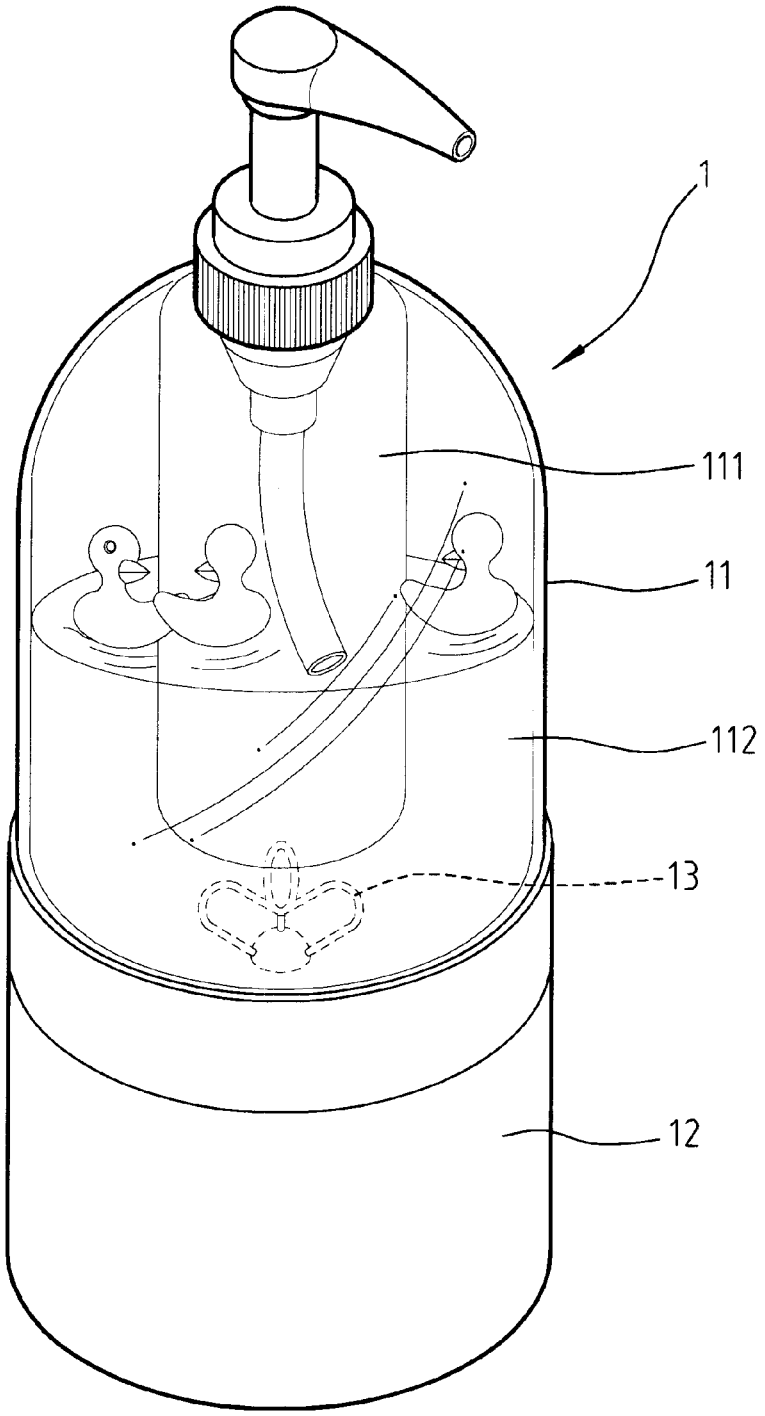
FIG. 7 is a perspective view to show the chamber is located in the performance unit of the dispenser of the present invention.
Figure 8:
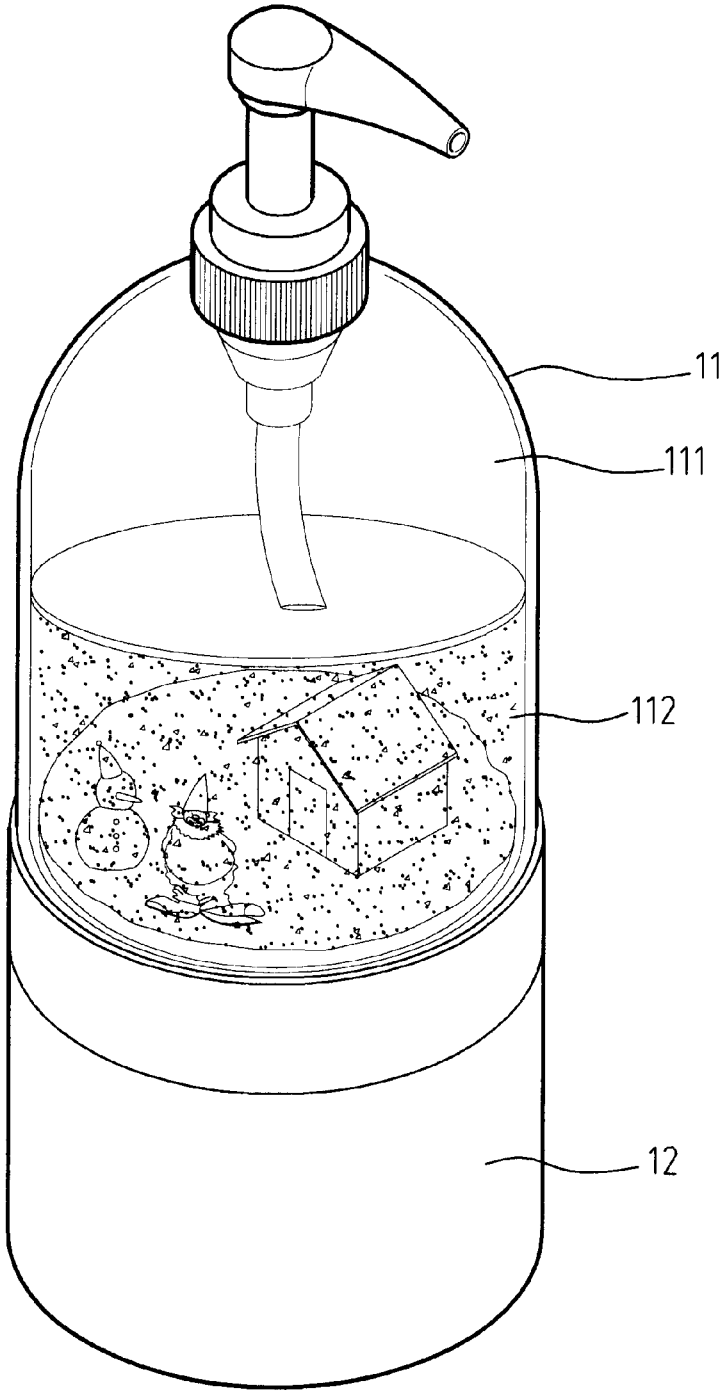
FIG. 8 is a perspective view to show other type of decoration members are located in the performance unit of the dispenser of the present invention.
Figure 9:
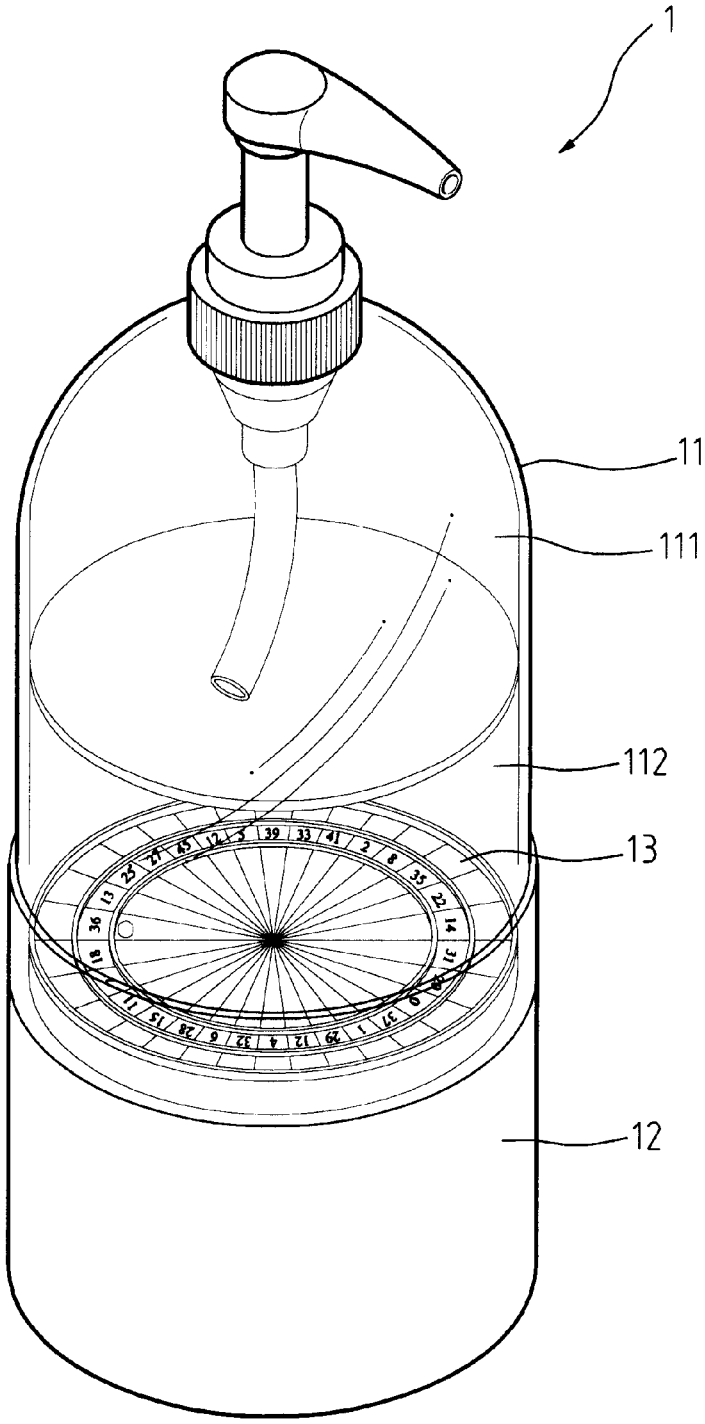
FIG. 9 is a perspective view to show another embodiment of the performance member.

As shown in FIG. 4, when pushing the squeeze device 10, the box 12 is lowered and the switch member 141 is touched by the plate 121 so that the activation member 14 is activated to rotate the performance member 13. FIG. 5 shows that the performance unit 112 occupies a half of the volume of the chamber 111 of the container 11. FIG. 6 shows that the performance unit 112 is filled with water and decoration fishes are located in the water so that when the performance member 13 is rotated, the water is stirred and the decoration fishes move. FIG. 7 shows that the chamber 111 is enclosed by the performance unit 112 in which water is filled and decoration ducks are floating on the water. FIG. 8 shows a snow scene is decorated in the performance unit 112. FIG. 9 shows that the performance member 13 is a roulette wheel.

Figure 10:
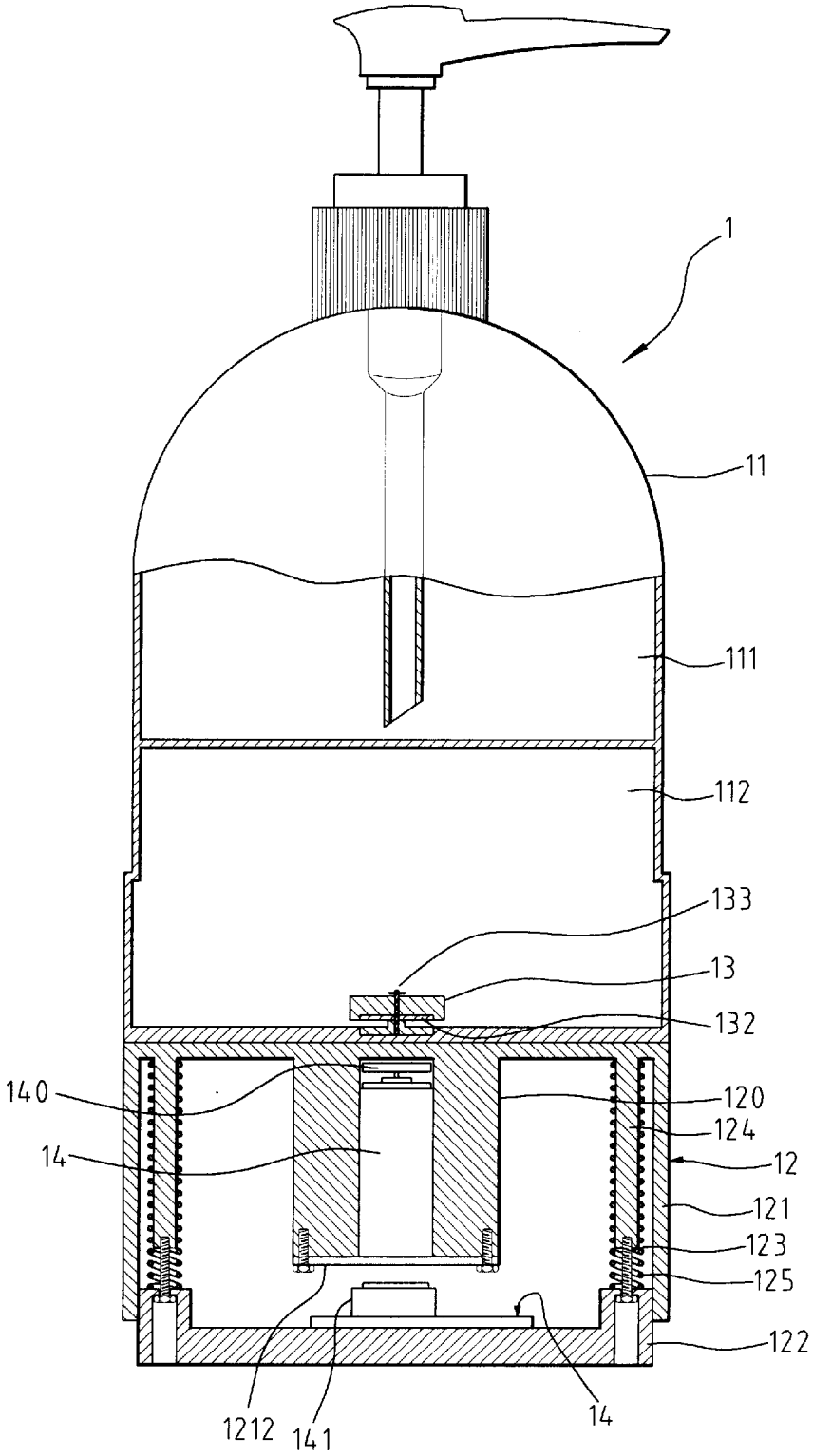
FIG. 10 is a cross sectional view to show yet another embodiment of the dispenser of the present invention.
Figure 11:
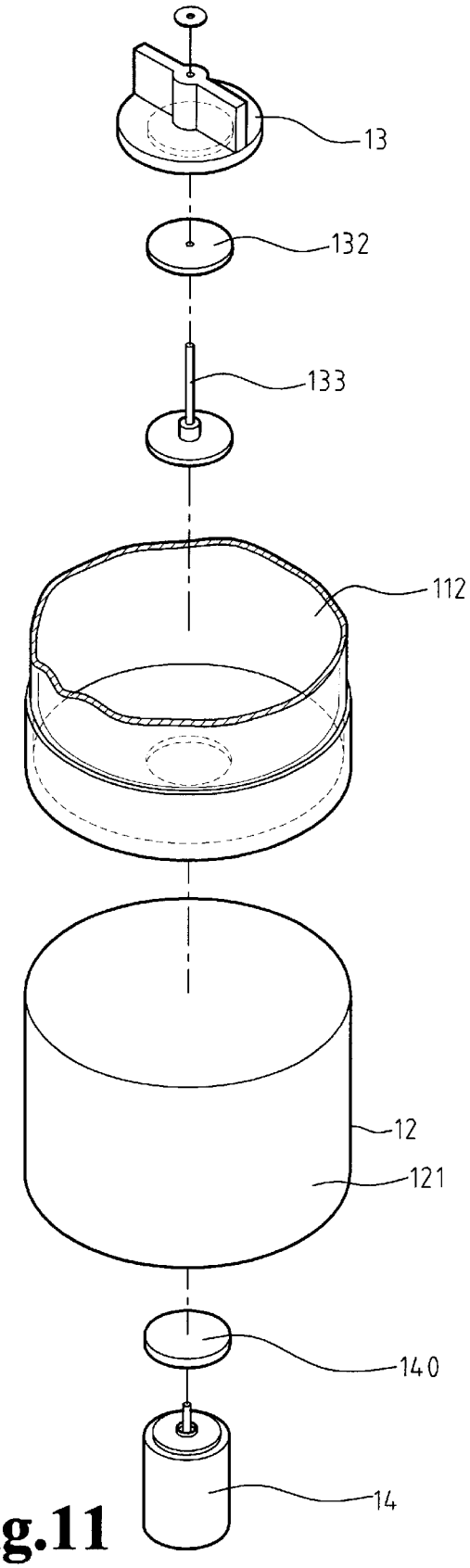
FIG. 11 is an exploded view to show the embodiment of the dispenser of the present invention as shown in FIG. 10.
Figure 12:
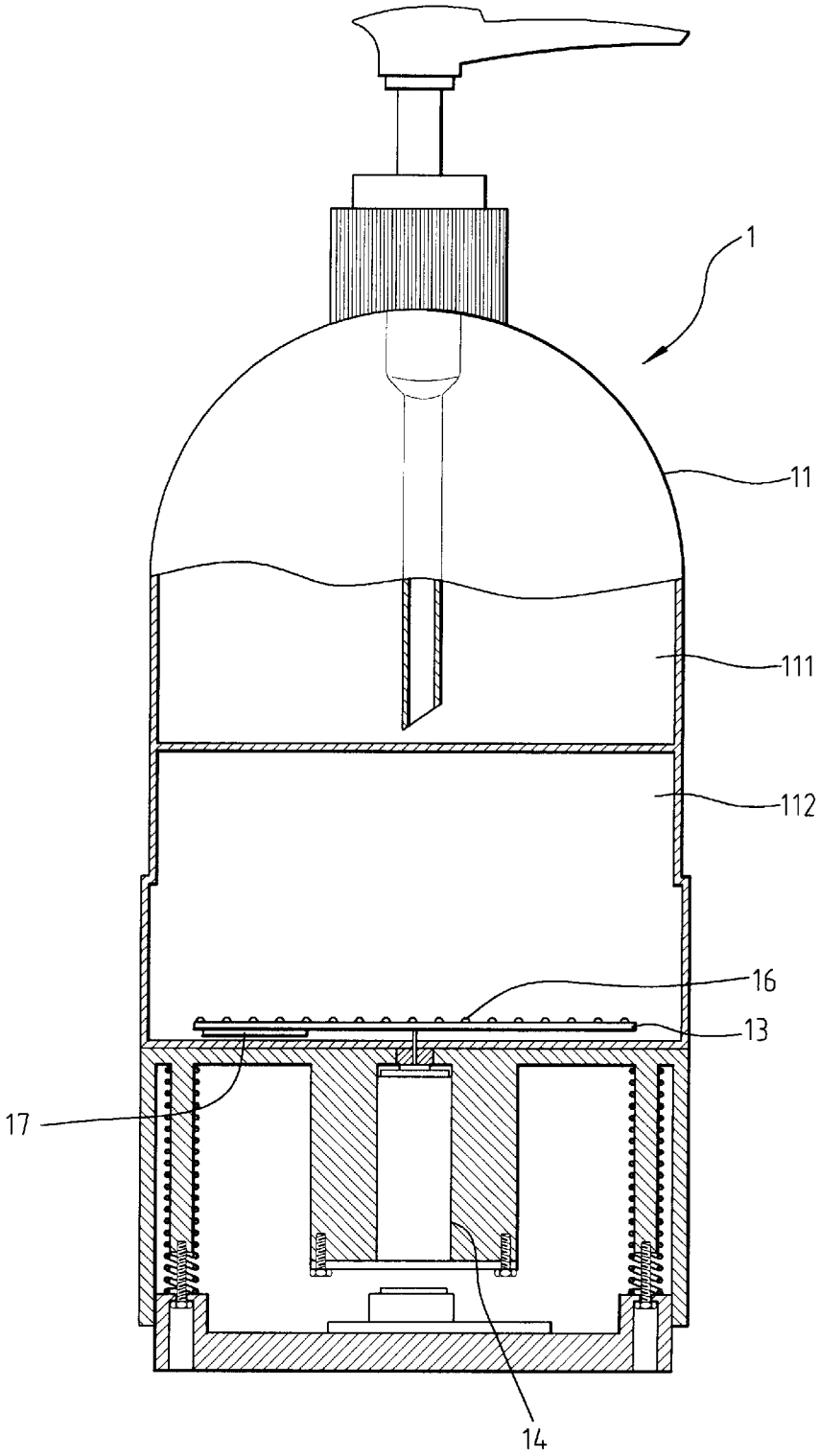
FIG. 12 is a cross sectional view to show a further embodiment of the dispenser of the present invention.

FIGS. 10 and 11 show that the performance member 13 is indirectly activated by the activation member 14, wherein a first magnetic member 140 is connected to the activation member 14 and the performance unit 112 has a pin 133 extending therefrom. The performance member 13 is rotatably mounted to the pin 133 and a second magnetic member 132 is connected to the performance member 13. The first magnetic member 140 is located below the second magnetic member 132 so that the performance member 13 is rotated when the first magnetic member 140 is rotated. FIG. 12 shows that the performance member 13 includes a plurality of lighting members 16 and sound-generation members 17 connected thereon so that when the performance is rotated, the lighting members 16 flash and sound or music is sent from the sound-generation members 17.

While we have shown and described various embodiments in accordance with the present invention, it should be clear to those skilled in the art that further embodiments may be made without departing from the scope of the present invention.

What is claimed is:

1. A dispenser comprising:

a container having a squeeze device connected on a top thereof and having a chamber defined therein, a performance unit connected to said container and a performance member located in said performance unit;

a box connected to said performance unit and an activation member received in said box, said performance member activated by said activation member, and a base having a switch member and movably engaged with said performance unit, a gap defined between said switch member and said activation member.

2. The dispenser as claimed in claim 1, wherein said box has a skirt and said base is enclosed by said skirt, a plurality of rods extending from an inside of said box and said base having rings extending from an inner periphery thereof, a plurality of bolts extending through said rings and engaged with said rods, each of said rods having a spring mounted thereto which contacts said rings.

3. The dispenser as claimed in claim 1, wherein said box has a tubular portion extending from an inside thereof and a recess is defined in said tubular portion from an underside of said tubular portion, said activation member received in said recess and a shaft of said activation member extending through said box so as to be connected to said performance member.

4. The dispenser as claimed in claim 3, wherein said activation member is a motor.

5. The dispenser as claimed in claim 3, wherein said performance member includes a plurality of lighting members connected thereon.

6. The dispenser as claimed in claim 3, wherein said performance member includes a plurality of sound-generation members connected thereon.

7. The dispenser as claimed in claim 1, wherein said performance member is indirectly activated by said activation member.

8. The dispenser as claimed in claim 7, wherein a first magnetic member is connected to said activation member and said performance unit has a pin extending therefrom, said performance member rotatably mounted to said pin and a second magnetic member connected to said performance member, said first magnetic member located below said second magnetic member.

* * * * *